US010679804B2

(12) United States Patent
Aoki et al.

(10) Patent No.: US 10,679,804 B2
(45) Date of Patent: Jun. 9, 2020

(54) SEALING STRUCTURE FOR A ROTARY ELECTRONIC COMPONENT

(71) Applicant: KABUSHIKI KAISHA TOKAI RIKA DENKI SEISAKUSHO, Aichi (JP)

(72) Inventors: Hiroshi Aoki, Aichi (JP); Yoshiharu Tsukahara, Kanagawa (JP); Satoshi Kuwabara, Kanagawa (JP); Naoki Hayashi, Kanagawa (JP)

(73) Assignee: KABUSHIKI KAISHA TOKAI RIKA DENKI SEISAKUSHO, Aichi (JP)

( * ) Notice: Subject to any disclaimer, the term of this patent is extended or adjusted under 35 U.S.C. 154(b) by 0 days.

(21) Appl. No.: 16/320,030

(22) PCT Filed: Jul. 20, 2017

(86) PCT No.: PCT/JP2017/026361
§ 371 (c)(1),
(2) Date: Jan. 23, 2019

(87) PCT Pub. No.: WO2018/021155
PCT Pub. Date: Feb. 1, 2018

(65) Prior Publication Data

US 2019/0228934 A1 Jul. 25, 2019

(30) Foreign Application Priority Data

Jul. 28, 2016 (JP) ..... 2016-148630
Jul. 3, 2017 (JP) ..... 2017-130113

(51) Int. Cl.
*H01H 19/06* (2006.01)
*H01H 9/04* (2006.01)
*H01H 19/14* (2006.01)

(52) U.S. Cl.
CPC ..... *H01H 19/06* (2013.01); *H01H 9/04* (2013.01); *H01H 19/14* (2013.01)

(58) Field of Classification Search
CPC ..... H01H 9/04–19/06; H01H 19/14; B60K 37/06–2370/126; B60K 2370/691; B60K 2370/692
See application file for complete search history.

(56) References Cited

U.S. PATENT DOCUMENTS 3,809,830 A 5/1974 Lockard et al.
2016/0358727 A1 12/2016 Miyagi

FOREIGN PATENT DOCUMENTS

EP 3493232 A1 * 6/2019 ..... H01H 19/14
JP 2010-9937 A 1/2010
(Continued)

OTHER PUBLICATIONS

International Search Report and Written Opinion issued in corresponding International Application No. PCT/JP2017/026361 dated Sep. 19, 2017.

*Primary Examiner* — Vanessa Girardi
(74) *Attorney, Agent, or Firm* — Roberts Calderon Safran & Cole P.C.

(57) ABSTRACT

A drip-proof structure of an electronic component includes a rotary body that includes a main body as an operating portion, a first case rotatably supporting the rotary body, a second case that supports the other side surface of the main body of the rotary body and houses, together with the first case, the rotary body, a sliding piece that changes its position to follow rotation of the rotary body, a circuit board that outputs an output signal corresponding to the rotational position of the rotary body, a cover that covers the first and second cases and the circuit board, and first and second drip-proof members arranged between the first case and the cover and between the second case and the cover, respectively.

4 Claims, 8 Drawing Sheets

(56) References Cited

FOREIGN PATENT DOCUMENTS

| | | | | | |
|---|---|---|---|---|---|
| JP | 2011-134573 | A | | 7/2011 | |
| JP | 2018026346 | | * | 2/2018 | ..... H01H 19/02 |
| JP | 2018-107127 | | * | 7/2018 | ..... H01H 9/04 |
| WO | 2015087366 | A1 | | 6/2015 | |

* cited by examiner

SEALING STRUCTURE FOR A ROTARY ELECTRONIC COMPONENT

CROSS-REFERENCE TO RELATED APPLICATIONS

The present application is a U.S. National Phase of PCT/JP2017/026361 filed on Jul. 20, 2017 claiming priority to Japanese Patent Applications No. 2016-148630 filed on Jul. 28, 2016 and No. 2017-130113 filed on Jul. 3, 2017. The disclosure of the PCT Application is hereby incorporated by reference into the present Application.

CROSS-REFERENCE TO RELATED APPLICATIONS

The present application claims priorities of Japanese patent application Nos. 2016/148630 and 2017/130113, the entire contents of which are incorporated herein by reference.

TECHNICAL FIELD

The present invention relates to a drip-proof structure of an electronic component.

BACKGROUND ART

A rotary electronic component is known in which a portion of an outer periphery of a rotary body of is exposed as an operating portion to the outside through an opening provided on an outer case, and an electrical function portion in a main case is driven by rotationally operating the operating portion with a finger etc. so as to cause a change in an output from the electrical function portion. In the rotary electronic component, a drip-proof structure of an electronic component is known in which a rubbery drip-proof sheet is installed so as to seal a gap between the opening and the rotary body to prevent a liquid from entering through the gap between the opening and the rotary body to contact with the electrical function portion (see, e.g., JP 2011/134573 A).

Another drip-proof structure of an electronic component is known in which an electrical function portion is covered with a waterproof case etc. to prevent liquid from contacting with the electrical function portion (see, e.g., JP 2010/9937 A).

CITATION LIST

Patent Literatures

JP 2011/134573 A
JP 2010/9937 A

SUMMARY OF INVENTION

Technical Problem

The drip-proof structure of an electronic component disclosed in JP 2011/134573 A may be poor in operability of the operating portion since the rubbery drip-proof sheet is in contact with the rotary body.

Also, concerning the drip-proof structure of the electronic component disclosed in JP 2010/9937 A, since it is necessary to separately provide the waterproof case etc., the number of components may increase and the size of the rotary electronic component itself may also increase.

It is an object of the invention to provide a drip-proof structure of an electronic component that is effective in drip-proofness and excellent in operability of the operating portion and allows downsizing of the component.

Solution to Problem

According to an embodiment of the invention, a drip-proof structure of an electronic component defined by [1] to [9] below is provided.

[1] A drip-proof structure of an electronic component, comprising:

- a rotary body that comprises a main body comprising a circular outer circumferential surface as an operating portion and a shaft portion provided on one side surface of the main body;
- a first case that comprises a bearing rotatably supporting the shaft portion of the rotary body;
- a second case that is provided integral with the first case so as to have an opening therebetween, supports the other side surface of the main body of the rotary body, and houses, together with the first case, the rotary body while exposing a portion of the circular outer circumferential surface of the rotary body through the opening;
- a sliding piece that is provided on the rotary body located inside the first and second cases and changes its position to follow rotation of the rotary body;
- a circuit board that comprises a sliding contact pattern to be in sliding contact with the sliding piece and outputs an output signal corresponding to the rotational position of the rotary body;
- a cover that comprises an exposure opening for exposing the portion of the circular outer circumferential surface of the rotary body exposed through the opening and covers the first and second cases and the circuit board; and
- first and second drip-proof members arranged between the first case and the cover and between the second case and the cover, respectively.

[2] The drip-proof structure of an electronic component according to [1], wherein the first drip-proof member is arranged between a portion of the first case constituting a surrounding area of the opening and a portion of the cover constituting a surrounding area of the exposure opening, and

- wherein the second drip-proof member is arranged between a portion of the second case constituting a surrounding area of the opening and a portion of the cover constituting the surrounding area of the exposure opening.

[3] The drip-proof structure of an electronic component according to [1] or [2], wherein the first and second drip-proof members extend in a direction orthogonal to an axial direction of the rotary body.

[4] The drip-proof structure of an electronic component according to [1] or [2], wherein the first and second drip-proof members comprise coupling portions extending in an axial direction of the rotary body.

[5] The drip-proof structure of an electronic component according to [4], wherein the first and second drip-proof members and the coupling portions are ring-shaped.

[6] The drip-proof structure of an electronic component according to any one of [3] to [5], wherein an outer circumferential shape of the bearing of the first case is arc-shaped, and wherein the first drip-proof member comprises a curved portion that is located on the bearing side and is formed in an arc shape engaging with the outer shape of the bearing of the first case.

[7] The drip-proof structure of an electronic component according to any one of [3] to [5], wherein the second drip-proof member is located on an opposite side of the rotary body to the bearing.

[8] The drip-proof structure of an electronic component according to [1], further comprising a drip-proof processing portion provided between the shaft portion of the rotary body and the bearing, wherein the drip-proof processing portion comprises an end portion of a cylindrical protruding portion serving as the bearing and receiving the shaft portion of the rotary body inserted therein, and a drip-proof recess formed on the shaft portion of the rotary body so as to be concentrically with the shaft portion and receiving the end portion of the protruding portion inserted therein.

[9] The drip-proof structure of an electronic component according to [1], further comprising a drip-proof portion provided between the other side surface of the main body of the rotary body and the second case, the drip-proof portion comprising a male-female interlocking connection.

Advantageous Effects of Invention

According to the invention, a drip-proof structure of an electronic component can be provided that is effective in drip-proofness and excellent in operability of the operating portion and allows downsizing of the component.

DESCRIPTION OF EMBODIMENTS

Figure 1:
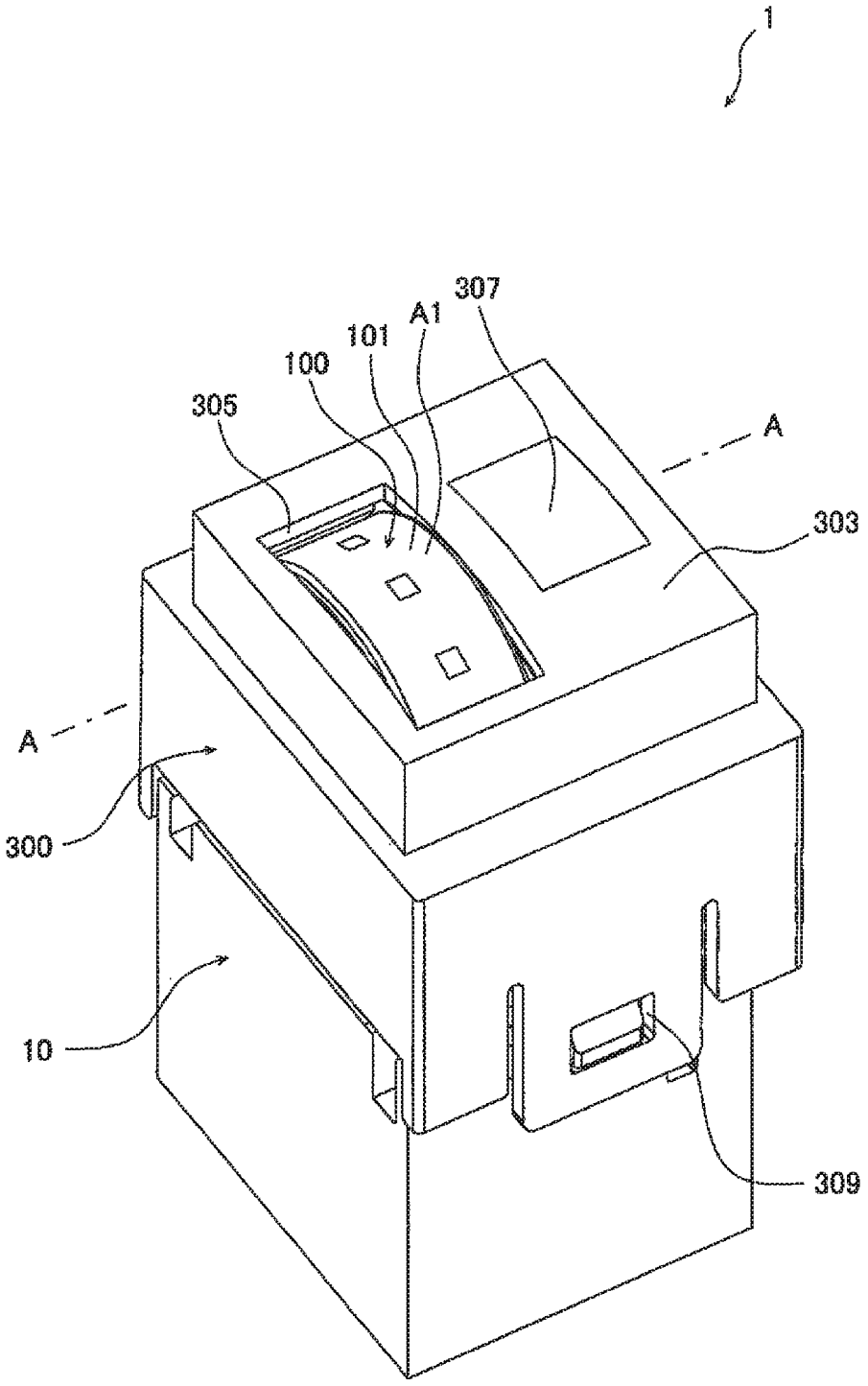
FIG. 1 is a perspective view showing a rotary electronic component in an embodiment.
Figure 2:
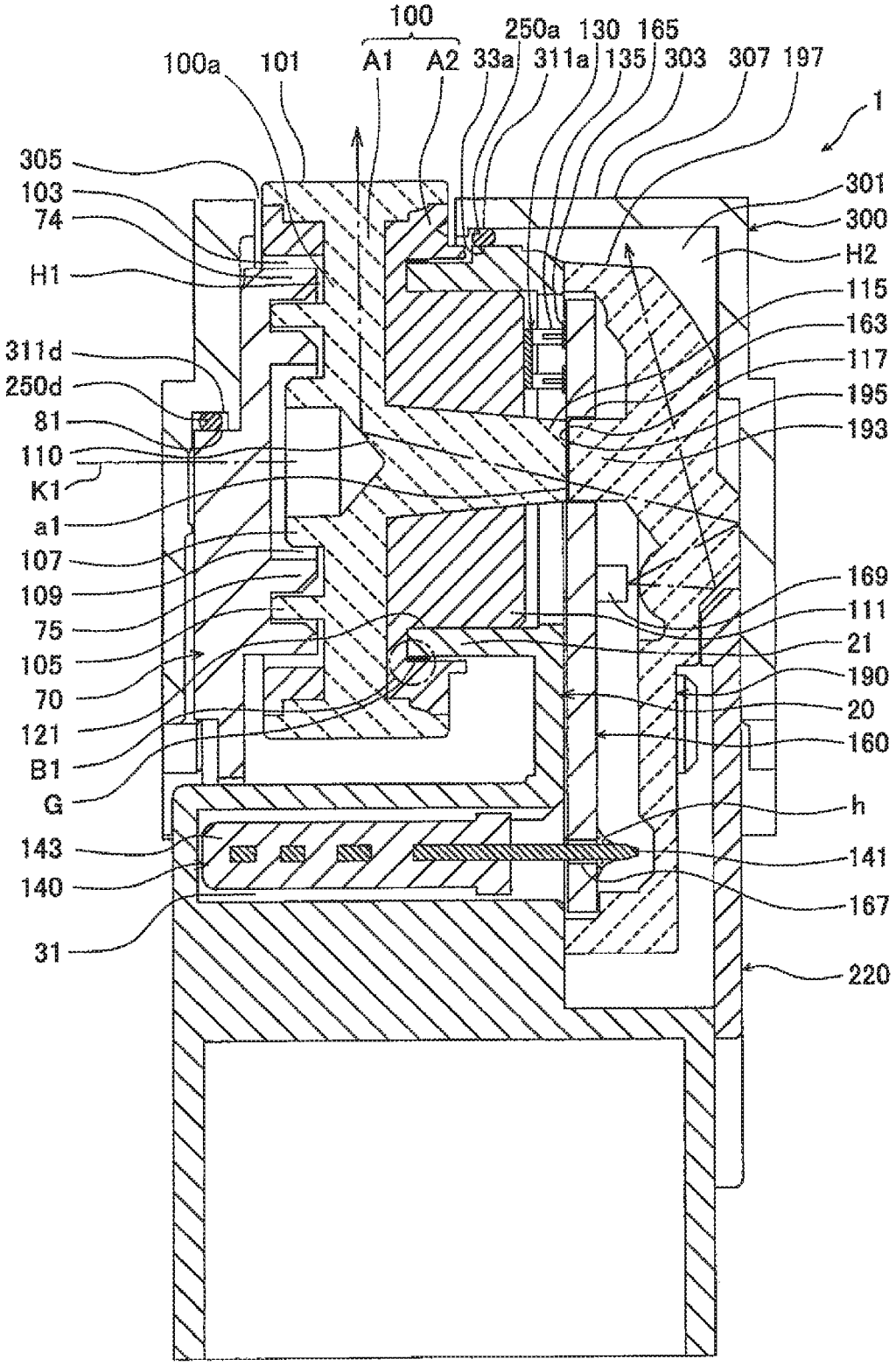
FIG. 2 is a cross sectional view showing the rotary electronic component taken along a line A-A in FIG. 1.
Figure 3:
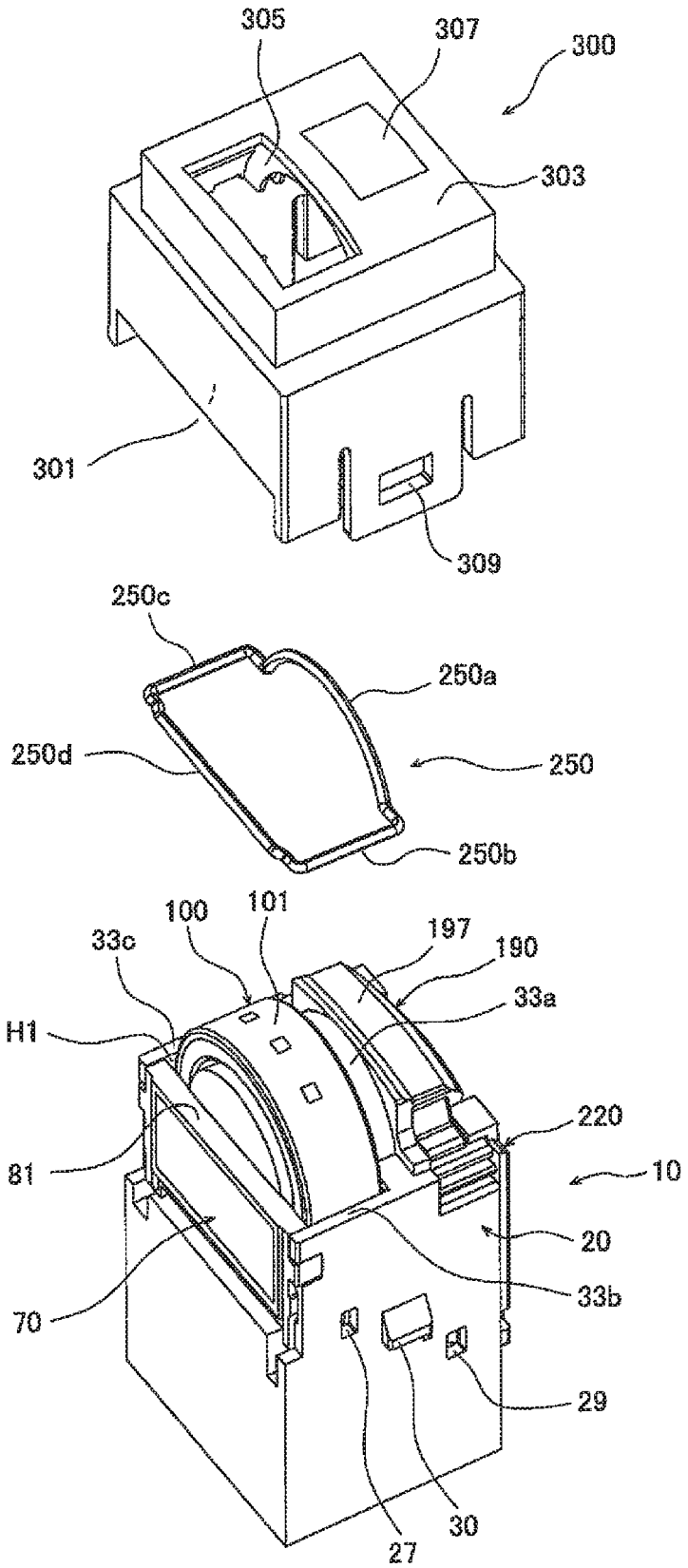
FIG. 3 is an exploded perspective view showing a main unit, a cover and drip-proof members.
Figure 4:
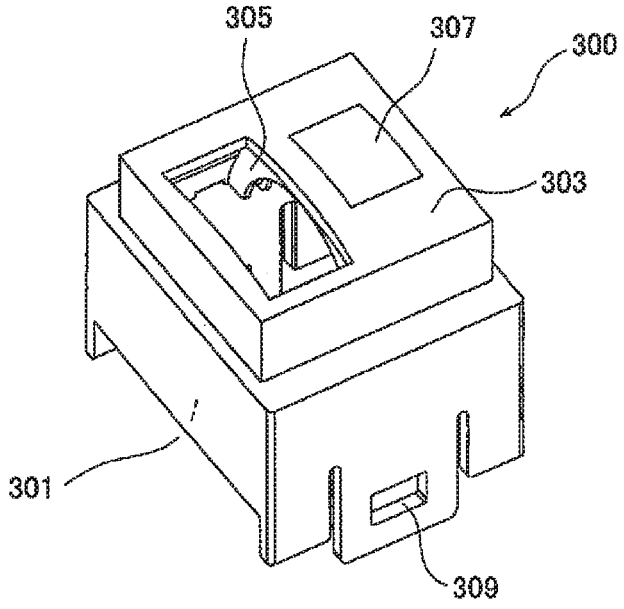
FIG. 4 is an exploded perspective view showing the state in which the cover is detached from the rotary electronic component.
Figure 4:
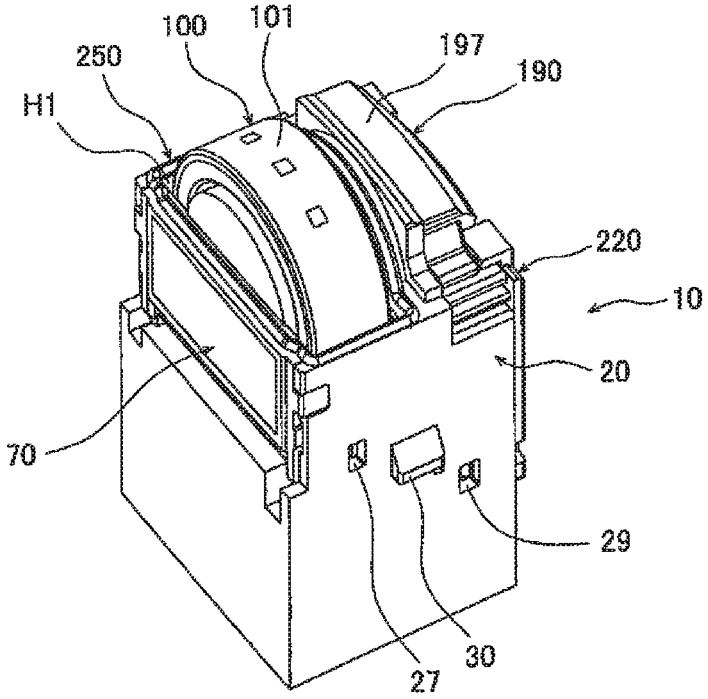
Figure 5:
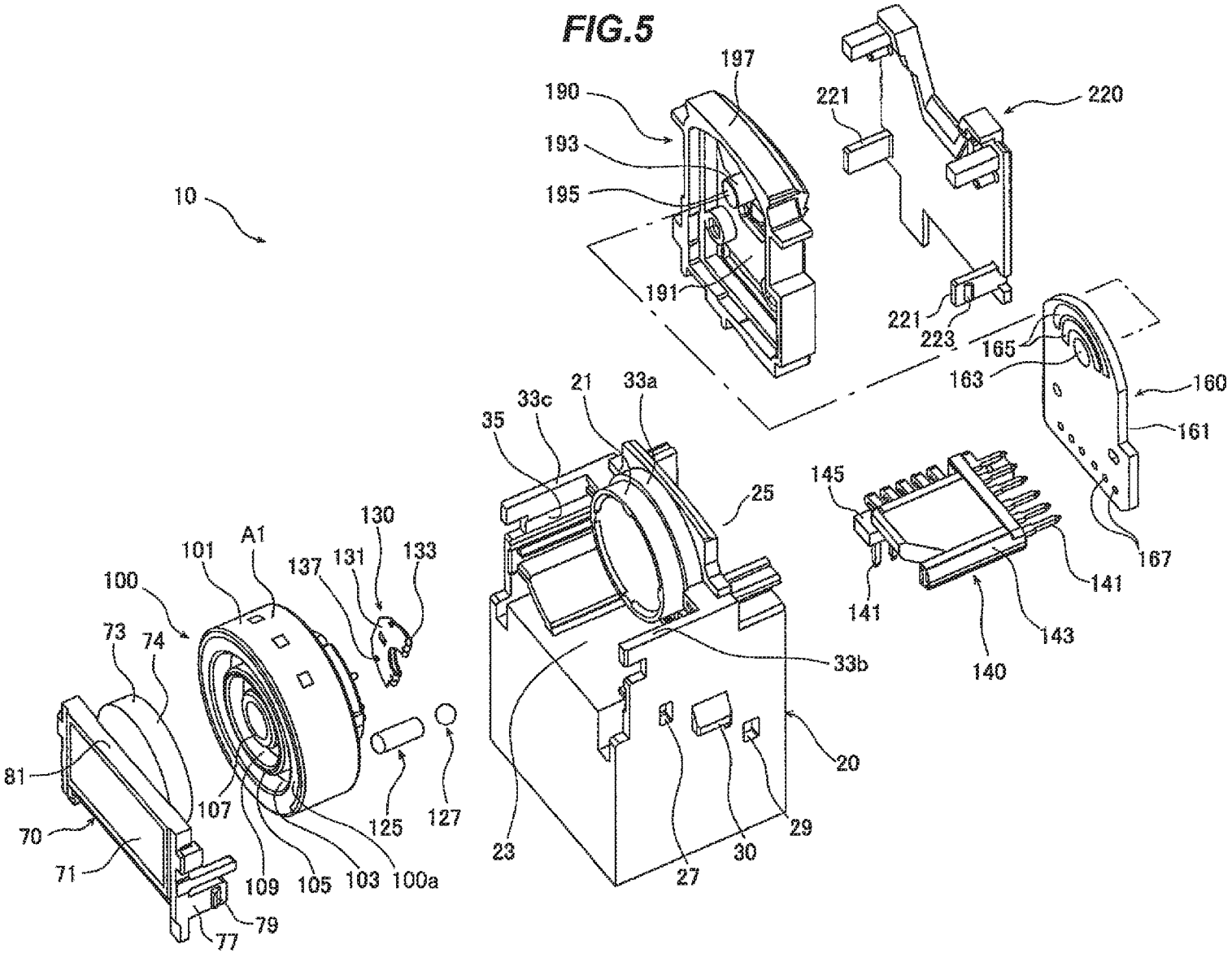
FIG. 5 is an exploded perspective view showing the main unit.
Figure 6:
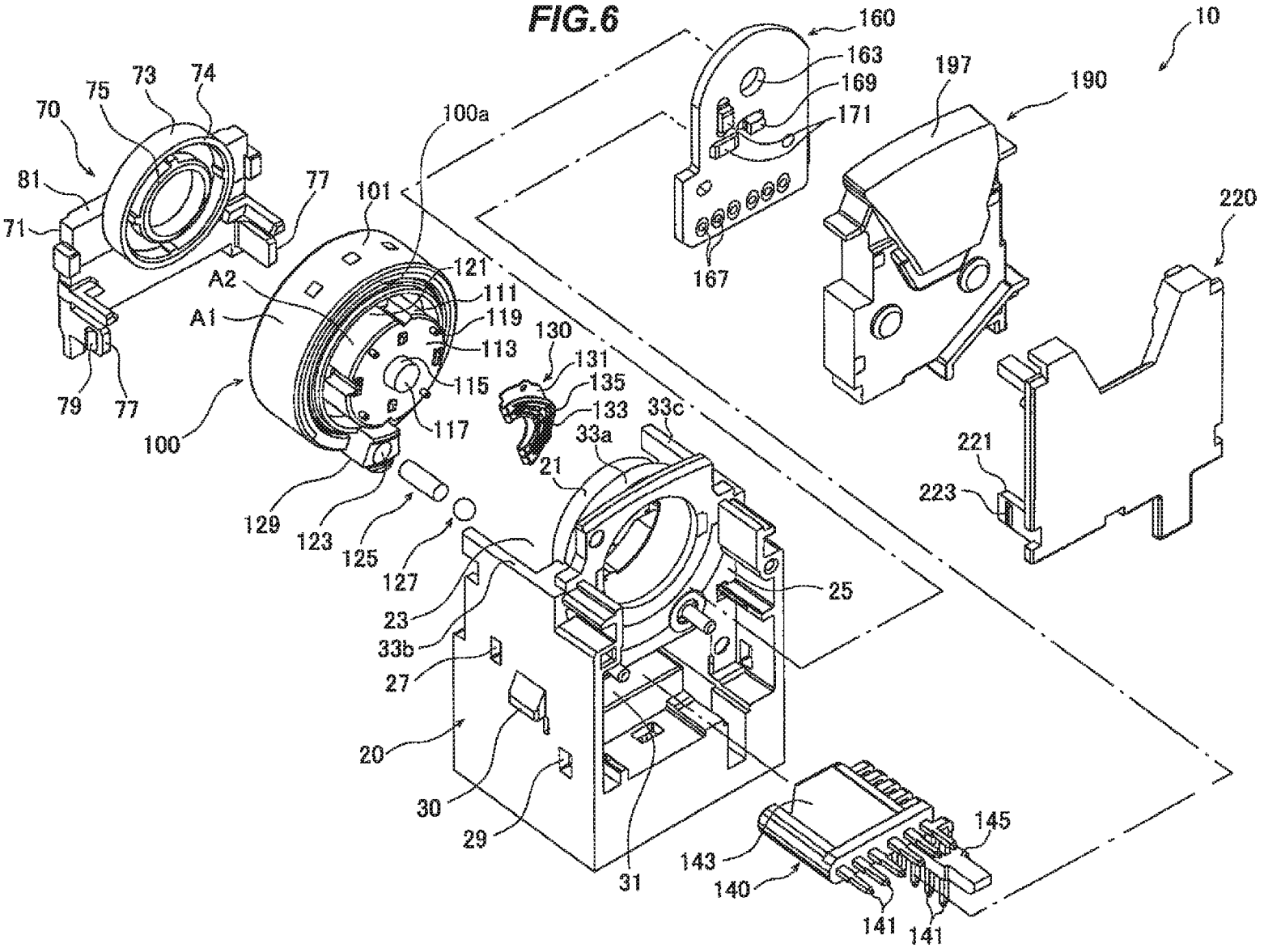
FIG. 6 is an exploded perspective view showing the main unit when viewed at an angle different from FIG. 5.

An embodiment of the invention will be described below in reference to the drawings. FIG. 1 is a perspective view showing an electronic component (hereinafter, referred to as "rotary electronic component") 1 configured using an embodiment of the present invention, FIG. 2 is a cross sectional view showing the rotary electronic component 1 (a cross section taken along the line A-A in FIG. 1), FIG. 3 is an exploded perspective view showing a main unit 10, a cover 300 and drip-proof members (hereinafter, referred to as "packings") 250 that constitute the rotary electronic component 1, FIG. 4 is a perspective view showing a process of attaching the packings 250 and the cover 300 to the main unit 10, FIG. 5 is an exploded perspective view showing the main unit 10, and FIG. 6 is an exploded perspective view showing the main unit 10 when viewed at another angle. As shown in these drawings, the rotary electronic component 1 is provided with the main unit 10 housing various parts, and the cover 300 covering a surface of the main unit 10 on the side where an operating knob 100 protrudes. In the following description, "upper/upward" is a direction to view the cover 300 from the main unit 10, and "lower/downward" is a direction opposite thereto. In addition, "front/forward" is a direction to view the operating knob 100 from a first case 20 (described later), and "rear/rearward" is a direction to view a circuit board 160 (described later) from the first case 20.

As shown in FIGS. 1 to 6, the main unit 10 is configured that the operating knob 100 as a rotary body, with a sliding piece 130 attached thereto, is housed between the first case 20 and a second case 70, a terminal unit 140 is housed in the first case 20 on the opposite side, and the circuit board 160, a light guide 190 and a third case 220 are provided thereon. The rotary electronic component 1 is formed by attaching the packings 250 and the cover 300 to the main unit 10.

The first case 20 is a molded article formed by molding a synthetic resin into a substantially rectangular box shape, and has a substantially cylindrical bearing 21 at the upper-center, a first housing portion 23 as a recess provided on the operating knob 100 side of the bearing 21, and a second housing portion 25 as a recess provided on the circuit board 160 side. A pair of engagement portions 27, which are rectangular through-holes to be engaged with claw portions 79 of the second case 70 (described later), are provided on both right and left side surfaces of the first case 20 at positions on the first housing portion 23 side. Meanwhile, a pair of engagement portions 29, which are rectangular through-holes to be engaged with claw portions 223 of the third case 220 (described later), are formed on both the right and left side surfaces of the first case 20 at positions on the second housing portion 25 side. In addition, a pair of claw-shaped engaging portions 30, which engage in engagement portions 309 of the cover 300 (described later), are formed both the right and left side surfaces of the first case 20 at positions between the engagement portions 27 and 29. A terminal unit housing portion 31, which has a substantially rectangular shape and opens rearward, is formed under the bearing 21. An arc surface portion of the bearing 21 at the middle of the upper surface and the upper surface portions located on right and left sides of the arc surface portion and protruding toward the first housing portion 23 serve as drip-proof member-mounting surfaces (hereinafter, referred to as "packing mounting surfaces") 33 (33*a* to 33*c*), where the arc surface portion is defined as a bearing-side drip-proof member-mounting surface 33*a*, and linear portions on both sides thereof are defined as right- and left-side packing mounting surfaces 33*b* and 33*c*. In addition, a pair of right and left stopper engaging portions 35 (only one is shown in FIG. 5) are formed, which butt against a stopper 129 of the operating knob 100 (described later) and prevent the stopper 129 from moving upward therebeyond. In addition, although it is not shown in the drawings, a click engaging portion composed of raised and recessed portions along an arc direction (a direction of the arc along which a click ball 127 moves (described later)) is formed in the first housing portion 23 at a lower portion (at a position facing the click ball 127) of a surface on which the bearing 21 is provided.

The second case 70 is formed in a single piece by molding a synthetic resin and has a case main body 71 having a substantially rectangular plate shape and a circular plate-shaped knob supporting portion 73 which protrudes from the uppercenter of the case main body 71 toward the operating knob 100. The knob supporting portion 73 is configured that an outer peripheral portion protruding from a surface on the operating knob 100 side is a cylindrical protruding portion 74 constituting a part of the drip-proof portion, and a protruding portion 75 having a bottomed cylinder shape is provided at the center inside the protruding portion 74. A pair of engaging claws 77 protrude from both right and left side edges of the case main body 71 toward the operating knob 100. The engaging claws 77 are flat plate-shaped members on which the claw portions 79 are provided near the end portions on both outer sides (only one claw portion 79 is shown in FIGS. 5 and 6). In addition, the upper surface of the case main body 71 serves as a non-bearing-side packing mounting surface 81 to be in contact with the packing 250 (described later).

The operating knob 100 is a molded article of a synthetic resin and is formed by co-molding a transparent material and an opaque material. The operating knob 100 has a substantially circular-plate shape and is configured that the circular outer circumferential surface thereof serves as an operating portion 101. A circular recessed portion 103 constituting a part of the drip-proof portion is provided on a surface of the operating knob 100 facing the second case 70, and two cylindrical protruding portions 105 and 107 are concentrically provided and protrude in the recessed portion 103. A circular recessed portion between the two protruding portions 105 and 107 is an insertion portion (recess) 109 into which the protruding portion 75 of the second case 70 is inserted. The protruding portion 74 of the knob supporting portion 73 of the second case 70 is also inserted into the recessed portion 103. The drip-proof portion by a male-female interlocking connection between the protruding portion 74 and the recessed portion 103 is thereby formed. Meanwhile, the recessed portion in the middle of the protruding portion 107 has a bottom surface which is recessed in a substantially cone shape and serves as a light-reflecting surface 110. A shaft portion 111 having a substantially circular-columnar shape protrudes from the center of a side surface (a surface facing the first case 20) of a main body 100*a* of the operating knob 100. An upper surface of the shaft portion 111 serves as a sliding piece attachment portion 113, and a truncated cone-shaped light-guiding protrusion 115 is further provided and protrudes from the center of the sliding piece attachment portion 113. An end face of the light-guiding protrusion 115 serves as a light introducing surface 117. Sliding piece attaching protrusions 119 formed of small pieces sticking out are formed on the sliding piece attachment portion 113. A ring-shaped drip-proof recess 121 is formed around the shaft portion 111. A click mechanism housing portion 123 formed of a bottomed circular hole is formed on the operating knob 100 at an outer peripheral portion of a surface facing the first case 20. A coil spring 125 and the click ball 127 are housed in the click mechanism housing portion 123. A portion around the click mechanism housing portion 123 bulges outward from the outer periphery of the operating knob 100 and the bulging portion serves as the stopper 129. The operating knob 100 is formed by molding two types of resins A1 and A2 into a single piece, as shown in FIG. 2. The resin A1 is a transparent resin and the resin A2 is an opaque resin. The whole transparent resin A1 constitutes a light guide and is molded so that the circular outer circumferential surface of the operating portion 101 is optically coupled to the light introducing surface 117 of the light-guiding protrusion 115.

The sliding piece 130 is formed of an elastic metal plate and is provided with a base portion 131 and arch-shaped arm portions 133 protruding from an outer surface of the base portion 131 and having a shape with U-turn at a root portion. A contact portion 135 which is curved and protrudes toward the circuit board 160 is formed at the center of each arm portion 133. Attachment holes 137 formed of small holes are also provided on the base portion 131.

The terminal unit 140 is formed by insert molding in which six metal-plate terminals 141 are molded in a substantially rectangular terminal case 143 consisting of a molding resin and a terminal holding case 145 having a substantially rectangular-prism shape. Each terminal 141 is arranged such that one end protrudes from a rear surface of the terminal case 143 so that the six ends are aligned in a row, and the other end protrudes from a side surface of the terminal case 143, is bent downward, is fixed by the terminal holding case 145 and then protrudes from a lower surface of the terminal holding case 145 so that the six ends are aligned in a row.

The circuit board 160 is configured that a circular through-hole 163 is provided at an upper portion of an insulating substrate 161 formed of a substantially rectangular hard plate, a sliding contact pattern 165 to be in sliding contact with the contact portions 135 of the sliding piece 130 is formed on a front surface of the insulating substrate 161 around the circular through-hole 163, six terminal insertion holes 167 formed of small holes for inserting one ends of the terminals 141 are formed horizontally in a row on the insulating substrate 161 in the vicinity of the lower edge, a light-emitting element 169 is attached to the rear surface of the insulating substrate 161 so as to be located below the through-hole 163, and various other electronic parts 171 are attached to predetermined positions. A circuit pattern (not shown) is formed on the insulating substrate 161 to electrically connect between the sliding contact pattern 165, the light-emitting element 169, the various other electronic parts 171 and the terminals 141 inserted into the terminal insertion holes 167. Various patterns such as switch pattern or resistor pattern can be used as the sliding contact pattern 165.

The light guide 190 is formed in a single piece by molding a transparent synthetic resin into a substantially rectangular box shape having an opening on the front side. On the front side, the light guide 190 has a substrate housing portion 191 having a recessed shape, and a circular-columnar protruding portion 193 protrudes from an upper portion of the bottom surface of the substrate housing portion 191. The substrate housing portion 191 is formed in a shape capable of housing and covering the entire circuit board 160. The protruding portion 193 has a size capable of being inserted into the through-hole 163 of the circuit board 160 and is configured that an end face serves as a light-emitting surface 195. The upper surface of the light guide 190 also serves as a light-emitting surface 197.

The third case 220 is formed in an outer shape which is a substantially rectangular plate shape and substantially covers the rear surface of the first case 20. A pair of engaging claws 221 protrude from both right and left sides of the third case 220 toward the first case. The engaging claws 221 are flat plate-shaped members on which the claw portions 223 are provided near the end portions on both outer sides.

As shown in FIG. 3, the packings 250 are formed of an elastic body such as elastomer into a substantially rectangular ring-shape with a circular cross section and form a shape in which the front side and the right and left sides are linear and the rear side has a curved portion which is curved upward in an arc shape. Here, a portion having the arc-shaped curved portion is defined as a bearing-side packing 250*a*, portions on the right and left sides are defined as right- and left-side packings 250*b* and 250*c*, and a portion on the front side is defined as a non-bearing-side packing 250*d*. The right- and left-side packings 250*b* and 250*c* serve as coupling portions for coupling the bearing-side packing 250*a* to the non-bearing-side packing 250*d* and contribute to improvement in assemblability and wobble prevention, in addition to the sealing effect. The curved portion of the bearing-side packing 250*a* matches the outer shape of the bearing 21 of the first case 20.

Figure 7:
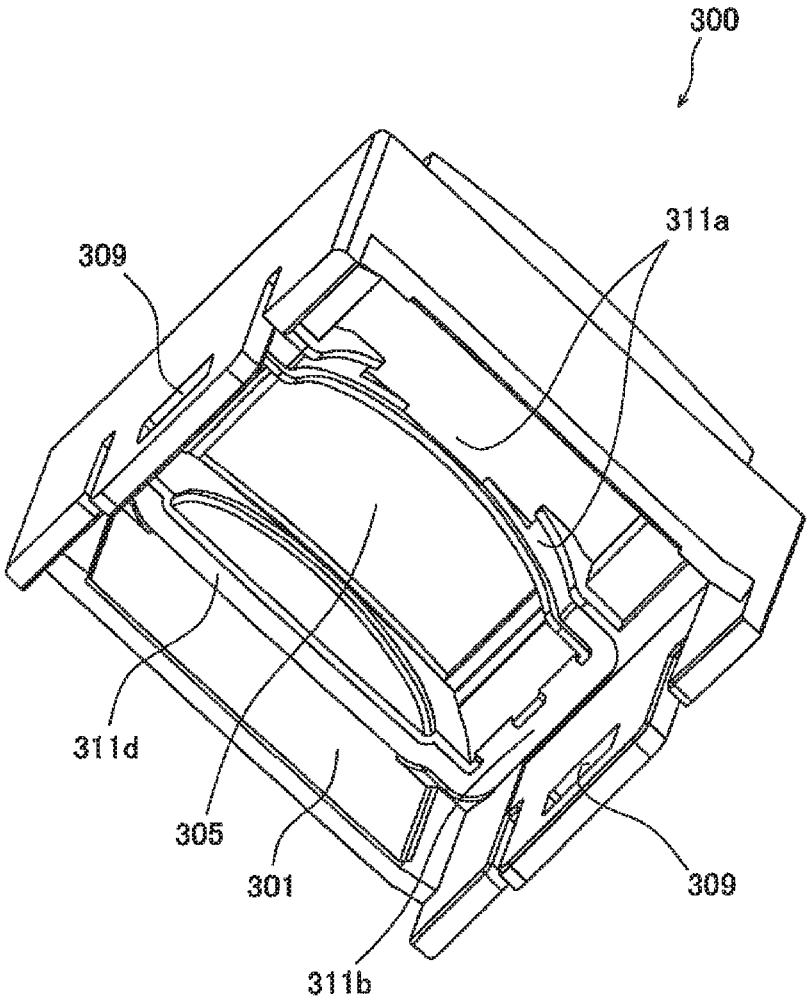
FIG. 7 is a perspective view showing the back of the cover.

FIG. 7 is a perspective view showing the cover 300 when viewed from the rear lower side. As shown in FIG. 7 and also FIGS. 2 and 3, the cover 300 is a molded article of a synthetic resin and is formed in a substantially rectangular box shape having an opening on the lower side so that a case main body-housing portion 301 for covering and housing the upper portion of the main unit 10 is formed on the lower side of the cover 300. On an upper surface (outside surface) 303 of the cover 300, an exposure opening 305 for exposing a portion of the operating portion 101 of the operating knob 100 is formed at a position facing the operating knob 100 and an illumination portion 307 is formed at a position facing the light-emitting surface 197 of the light guide 190. The illumination portion 307 is formed by cutting a desired shape, such as letter/character or symbol, out of an opaque coating material applied to a surface of a transparent molded resin constituting the cover 300, but may be formed by other methods. The engagement portions 309, which are rectangular through-holes to be engaged with the engaging portions 30 of the first case 20, are respectively formed on both the right and left side surfaces of the cover 300. Drip-proof member-mounting surfaces (hereinafter, referred to as "packing mounting surfaces") 311 (311*a* to 311*d*) are formed on the back surface of the cover 300 so as to surround the exposure opening 305. The packing mounting surfaces 311 consist of a bearing-side packing mounting surface 311*a* in an arc shape convex toward the exposure opening 305, linear-shaped right- and left-side packing mounting surfaces 311*b* and 311*c* on both sides thereof (311*c* is not shown), and a non-bearing-side packing mounting surface 311*d* having a linear shape and located on the opposite side to the bearing-side packing mounting surface 311*a*, which together form one substantially rectangular ring-shaped surface (the same shape as that formed by the packings 250). In other words, the bearing-side packing mounting surface 311*a* is formed at a position along the shape of an arc-shaped portion around the rim of the exposure opening 305, and the non-bearing-side packing mounting surface 311*d* is formed at a position away from the arc-shaped portion around the rim of the exposure opening 305.

Next, assembly of the rotary electronic component 1 will be described. Firstly, the main unit 10 is assembled. In detail, the base portion 131 of the sliding piece 130 is pre-placed on the sliding piece attachment portion 113 of the operating knob 100. At this time, the sliding piece 130 is attached by heat staking (or only press-fitting) the tips of the sliding piece attaching protrusions 119 of the sliding piece attachment portion 113 which are inserted into the attachment holes 137 of the sliding piece 130. Also, grease G for drip-proofing is applied to fill the drip-proof recess 121 of the operating knob 100. Meanwhile, the tip of each terminal 141 protruding from the rear of the terminal unit 140 is inserted into the corresponding terminal insertion hole 167 of the circuit board 160 and is fixed on the opposite side to the circuit pattern (not shown) on the circuit board by solder h (see FIG. 2).

Then, the operating knob 100, with the sliding piece 130 attached thereto and also the coil spring 125 and the click ball 127 housed in the click mechanism housing portion 123, is arranged to be housed in the first housing portion 23 of the first case 20 in such a manner that the shaft portion 111 of the operating knob 100 inserted into the bearing 21 of the first case 20 is rotatably supported. In this state, the bearing 21 of the first case 20 is inserted in the drip-proof recess 121 of the operating knob 100 which is filled with the grease G, and this provides a drip-proof processing portion B1. Next, the second case 70 is attached to cover the front side surface of the operating knob 100. Once the claw portions 79 of the engaging claws 77 are engaged with the engagement portions 27 of the first case 20, the second case 70 and the first case 20 are attached to each other with the operating knob 100 sandwiched therebetween. The second case 70 is attached such that the knob supporting portion 73 covers the other side surface (the front side surface) of the operating knob 100, the protruding portion 75 is inserted into the insertion portion 109 of the operating knob 100, and the protruding portion 74 is inserted into the recessed portion 103.

Next, the circuit board 160 with the terminal unit 140 attached thereto and the light guide 190 are arranged to be housed in the second housing portion 25 of the first case 20, and the third case 220 is placed thereover. Then, the claw portions 223 of the third case 220 are respectively engaged with the engagement portions 29 of the first case 20. The main unit 10 shown in FIG. 3 is thereby completed.

In this state, an opening H1 is formed on the upper surface between the first case 20 and the second case 70, and an opening H2 is formed on the upper surface between the first case 20 and the third case 220 (see FIG. 2). A portion of the operating portion 101 of the operating knob 100 is exposed (protrudes) in the opening H1. Meanwhile, the light-emitting surface 197 of the light guide 190 is exposed in the opening H2 so as to protrude externally (upward). Then, the contact portions 135 of the sliding piece 130 are in contact with the sliding contact pattern 165 of the circuit board 160, as shown in FIG. 2. In addition, in this state, the terminal unit 140 is housed in the terminal unit housing portion 31. Furthermore, the outer peripheral portion of the light guide 190 is in contact with a surface of the first case 20 facing the light guide 190 and encircles the circuit board 160. Furthermore, the protruding portion 193 of the light guide 190 is inserted into the through-hole 163 of the circuit board 160 so that the tip of the light-emitting surface 195 located at the end thereof closely faces the light introducing surface 117 of the operating knob 100.

Next, the packings 250 shown in FIG. 3 are inserted into the case main body-housing portion 301 of the cover 300 and are placed in contact with the packing mounting surfaces 311 (311*a* to 311*d*) of the cover 300. Then, the cover 300 with the packings 250 installed thereon is attached to the main unit 10 from above. In other words, the upper portion of the main unit 10 is housed in the case main body-housing portion 301 of the cover 300. Then, the engaging portions 30 of the main unit 10 are respectively engaged with engagement portions 309 of the cover 300. Assembly of the rotary electronic component 1 is thereby completed. Note that, the above-mentioned assembly process is only an example and it is obvious that various other assembly processes may be use for assembly. For example, instead of attaching the packings 250 to the cover 300, the packings 250 may be attached to the main unit 10 which is then covered with the cover 300. In this case, ribs, etc., for preventing the packings 250 from coming out of alignment are preferably formed on at least some of the packing mounting surfaces 33 (33*a* to 33*c*) and the non-bearing-side packing mounting surface 81 of the main unit 10.

FIG. 4 is an exploded perspective view showing the state in which only the cover 300 is detached from the assembled rotary electronic component 1. As understood from FIG. 4, the packings 250 in the rotary electronic component 1 are in contact with the main unit 10 in the surrounding area of the hole the opening H1 which is formed by combining the first and second cases 20 and 70. In detail, among the packings 250, the bearing-side packing 250*a* is in contact with the bearing-side drip-proof member-mounting surface 33*a* of the first case 20, the right- and left-side packings 250*b* and 250*c* are in contact with the right- and left-side packing mounting surfaces 33*b* and 33*c* of the first case 20, and the non-bearing-side packing 250*d* is in contact with the non-bearing-side packing mounting surface 81 of the second case 70.

Meanwhile, a portion of the operating portion 101 of the operating knob 100 is exposed through the exposure opening 305, as shown in FIGS. 1 and 2. The light-emitting surface 197 of the light guide 190 is arranged at a position facing the lower surface (the back surface) of the illumination portion 307 of the cover 300. Then, in the assembled state, the bearing-side packing 250*a* is in contact with the bearing-side packing mounting surface 311*a*, the right- and left-side packings 250*b* and 250*c* are in contact with the right- and left-side packing mounting surfaces 311*b* and 311*c*, and the non-bearing-side packing 250*d* is in contact with the non-bearing-side packing mounting surface 311*d*, hence, the packings 250 are sandwiched between the packing mounting surfaces 33 (33*a* to 33*c*)/the non-bearing-side packing mounting surface 81 of the main unit 10 and the cover 300 and seals between the main unit 10 and the cover 300.

In the rotary electronic component 1 assembled as described above, when the operating knob 100 is rotated, the contact portions 135 of the sliding piece 130 slide on the sliding contact pattern 165 of the circuit board 160 and this produces a difference in the detection output between the terminals 131. When rotating the operating knob 100, the grease G causes some resistance but a large torque is not required to rotate the operating knob 100 since the packings 250 are not in contact therewith at all, hence, operability is not impaired. The operating knob 100, when rotated, does not rotate more than about half of a turn since the stopper 129 thereof (see FIG. 6) butts against the pair of right and left stopper engaging portions 35 (only one is shown in FIG. 5) provided in the first housing portion 23 of the first case 20. In other words, the operating knob 100 is moves in an arc motion.

When the light-emitting element 169 is turned on, light therefrom is introduced into and reflected by the light guide 190, is then emitted from the light-emitting surface 197, and illuminates the illumination portion 307 of the cover 300 from the back side thereof, as indicated by a dot-and-dash line. On the other hand, the light reflected inside the light guide 190 and emitted from the light-emitting surface 195 is introduced into the resin A1 from the light introducing surface 117 of the operating knob 100, is reflected therein and guided to the circular outer circumferential surface of the operating portion 101, and illuminates the operating portion 101.

Figure 8:
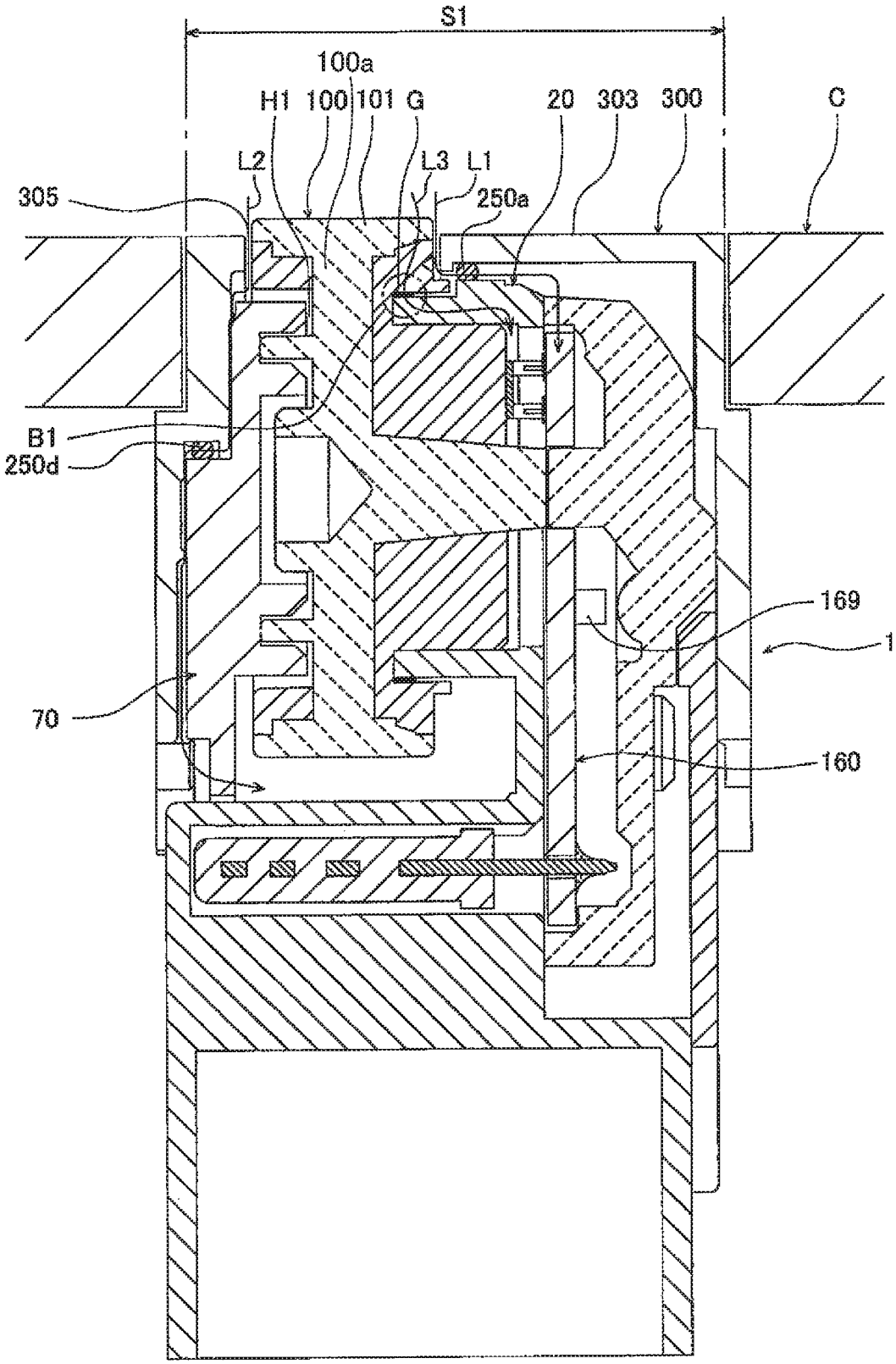
FIG. 8 is a cross sectional view showing a liquid ingress path into the rotary electronic component.

In the meantime, the rotary electronic component 1 is installed on an operation panel C of an electronic device, as shown in FIG. 8. When installed, the upper surface 303 of the cover 300 is exposed, as the outside surface, to the outside of the operation panel C. Liquid may spill on the upper surface 303 exposed to the outside of the operation panel C. The spilled liquid enters inside the cover 300 through the exposure opening 305. The entered liquid tries to advance from the surrounding area of the operating portion 101 of the operating knob 100 toward the circuit board 160 by passing through a gap between the cover 300 and the first case 20 as indicated by an arrow L1, by passing through a gap between the cover 300 and the second case 70, moving down along the outer surface of the second case 70 and going under its lower edge and around to the opposite side of the operating knob 100 as indicated by an arrow L2, or by passing through the opening H1 of the main unit 10 as indicated by an arrow L3.

In the rotary electronic component 1, however, ingress of the liquid advancing toward the circuit board 160 by passing through a gap between the cover 300 and the first case 20 as indicated by the arrow L1 is prevented by the bearing-side packing 250*a*. Then, ingress of the liquid advancing toward the circuit board 160 by passing through a gap between the cover 300 and the second case 70, moving down along the outer surface of the second case 70 and going under its lower edge of and around to the opposite side of the operating knob 100 as indicated by the arrow L2 is prevented by the non-bearing-side packing 250*d*. Meanwhile, the liquid entered through the opening H1 of the main unit 10 as indicated by the arrow L3 passes in the surrounding area of the operating knob 100 and is directly drained downward, but the liquid advancing toward the sliding piece 130 is blocked by the drip-proof processing portion B1 and the ingress thereof is prevented. As such, drip-proof against the liquid entering through the exposure opening 305 of the cover 300 is effectively provided at each of these points.

As described above, the rotary electronic component 1 is configured that the operating knob 100 moving in a circular motion (including an arc motion and an oscillatory motion) about an axis K (see FIG. 2) is arranged on one side of the circuit board 160, a detection means composed of the sliding piece 130 and the sliding contact pattern 165 and changing its output according to the motion of the operating knob 100 is provided between the operating knob 100 and the circuit board 160, at least the operating knob 100 is housed in the first and second cases 20 and 70, a portion of the operating portion 101 on the outer surface of the operating knob 100 is exposed through the opening H1 provided on the first and second cases 20 and 70, the cover 300 having the exposure opening 305 for exposing the portion of the operating portion 101 of the operating knob 100 is attached to cover the outer surface of the first and second cases 20 and 70 on which the opening H1 is provided, and the packings 250 are sandwiched and held between a surrounding area of the opening H1 of the first and second cases 20 and 70 and a surrounding area of the exposure opening 305 of the cover 300 and prevent ingress of liquid from the exposure opening 305 of the cover 300 through a gap between the first and second cases 20 and 70 and the cover 300.

In addition, since the shaft portion 111 provided on the operating knob 100 so as to protrude from a side surface on the circuit board 160 side is rotatably inserted into the bearing 21 protruding from the first case 20 at a position near the detection means and the drip-proof processing portion B1 is provided at the end portion of the bearing 21 into which the shaft portion 111 is inserted, liquid which is not blocked by the packings 250 and enters the first and second cases 20 and 70 from the opening H1 of the first and second cases 20 and 70 is prevented from entering by a portion of the bearing 21 inside the first and second cases 20 and 70.

Thus, it is possible to prevent ingress of liquid into the detection means and the circuit board 160 more effectively.

The bearing-side packing 250*a*, which is the packing 250 arranged on the side where the surface of the operating knob 100 with the shaft portion 111 attached (the one side surface) is located, is arranged at a position along the operating portion 101 of the operating knob 100. Thus, the bearing-side packing 250*a*, which is arranged on the side where the circuit board 160 is located, prevents ingress of liquid at a position in the vicinity of the operating portion 101 of the operating knob 100 (immediately after the position of liquid ingress). On the other hand, the non-bearing-side packing 250*d*, which is the packing 250 arranged on the side where the surface (the other side surface) of the operating knob 100 opposite to the surface with the shaft portion 111 attached is located, is arranged in the vicinity of the axis K of the operating knob 100. Thus, the non-bearing-side packing 250*d*, which is arranged on the side where the circuit board 160 is not located, provides drip-proof protection near the center of the side surface of the operating knob 100 which is distant from the operating portion 101 of the operating knob 100. That is, the drip-proof effect at the portion near the circuit board 160 side is enhanced by providing drip-proof protection at a position in the vicinity of the exposure opening 305 of the cover 300. On the other hand, in a region on the opposite side of the operating knob 100 which is distant from the circuit board 160, the non-bearing-side packing 250*d* is arranged at a position rearward (downward) of the operating portion 101 of the operating knob 100, which allows a width dimension S1 of a portion of the cover 300 in the vicinity of the exposure opening 305 (see FIG. 8) to be reduced. The portion of the cover 300 in the vicinity of the exposure opening 305 is a portion exposed on the operation panel C of the electronic device when the rotary electronic component 1 is mounted thereon. Since the width dimension S1 of such portion can be reduce, it is possible to reduce the size or thickness, etc., of the operation panel C as well as of the electronic device provided with the operation panel C.

It is also configured such that the circular recessed portion 103 is provided on the operating knob 100 on a surface opposite to the surface with the shaft portion 111 attached, the cylindrical protruding portion 74 to be inserted into the recessed portion 103 is provided on a surface of the second case 70 facing the surface with recessed portion 103, and the recessed portion 103 engages with the protruding portion 74. Thus, even when liquid enters through the opening H1 of the first and second cases 20 and 70, the liquid is prevented from further advancing through a gap between the second case 70 and the surface of the operating knob 100 on the opposite side to the shaft portion 111.

The following configurations and effects can be included in and achieved by the invention.

(1) A drip-proof structure is used for an electronic component in which an operating knob moving in a circular motion, an arc motion or an oscillatory motion about an axis is arranged on one side of a circuit board, a detection means changing its output according to the motion of the operating knob is provided between the operating knob and the circuit board, at least the operating knob is housed in a case, a portion of an operating portion on the outer surface of the operating knob is exposed through an opening provided on the case, and a cover having an exposure opening for exposing the portion of the operating portion of the operating knob is attached to cover the outer surface of the case on which the opening is provided, and the drip-proof structure of the electronic component is configured that drip-proof members are sandwiched and held between a surrounding area of the opening of the case and a surrounding area of the exposure opening of the cover and prevent ingress of liquid from the exposure opening of the cover through a gap between the case and the cover.

This configuration effectively provides drip-proof against the liquid entering from the exposure opening of the cover through a gap between the case and the cover. In addition, since the drip-proof members are not in contact with the operating knob at all, operability when rotating the operating knob is not impaired.

The drip-proof members are preferably formed of an elastic material, etc., and form a ring shape, but may be formed of a different material and have a different shape and structure. In addition, the drip-proof members do not necessarily need to completely surround the exposure opening of the cover (or the opening of the case) and may surround partially.

(2) The drip-proof structure of the electronic component described in the above (1) is configured that a shaft portion is provided on the operating knob so as to protrude from a side surface on the circuit board side, the shaft portion is rotatably inserted into a bearing protruding from the case at a position near the detection means, and a drip-proof processing portion is provided at an end portion of the bearing into which the shaft portion inserted.

In this configuration, liquid which is not blocked by the drip-proof members and enters the case from the opening of the case is prevented from advancing by the end portion of the bearing inside the case and it is thus possible to prevent ingress of liquid into the detection portion and the circuit board more effectively.

Various drip-proof structures such as applying grease or providing a packing can be used to form the drip-proof processing portion. The position to provide grease or packing, etc., may be any of the inner circumferential surface side, the end face side and the outer circumferential surface side of the bearing.

(3) The drip-proof structure of the electronic component described in the above (1) or (2) is configured that the drip-proof member, which is arranged on the side where the surface of the operating knob with the shaft portion attached is located, is arranged at a position along the operating portion of the operating knob, and the drip-proof member, which is arranged on the side where the surface of the operating knob opposite to the surface with the shaft portion attached is located, is arranged in the vicinity of the axis of the operating knob.

In this configuration, the drip-proof member, which is arranged on the side where the circuit board is located, prevents ingress of liquid at a position in the vicinity of the operating portion on the outer periphery of the operating knob (immediately after the position of liquid ingress). On the other hand, the drip-proof member, which is arranged on the side where the circuit board is not located, provides drip-proof protection near the center of the side surface of the operating knob which is distant from the operating portion on the outer periphery of the operating knob. That is, the drip-proof effect on the circuit board side is enhanced by providing drip-proof protection at a position in the vicinity of the exposure opening of the cover. On the other hand, in a region on the opposite side of the operating knob which is distant from the circuit board, the drip-proof member is arranged at a position rearward (downward) of the operating portion of the operating knob, which allows a width dimension of a portion of the cover in the vicinity of the exposure opening to be reduced. The portion of the cover in the vicinity of the exposure opening is a portion exposed on an operation panel of an electronic device when the electronic component is mounted thereon. Since the width dimension of such portion can be reduce, it is possible to reduce the size or thickness of the operation panel of the electronic device.

(4) The drip-proof structure of the electronic component described in any one of the above (1) to (3) is characterized in that a circular recessed portion is provided on the operating knob on a surface opposite to the surface with the shaft portion attached, a cylindrical protruding portion to be inserted into the recessed portion is provided on a surface of the case facing the surface with recessed portion, and the recessed portion engages with the protruding portion.

This configuration prevents ingress of liquid from the exposure opening of the cover through a gap between the case and the operating knob and it is thereby possible to prevent ingress of liquid into the circuit board more effectively.

Although the embodiment of the invention has been described above, the invention is not intended to be limited to the embodiment, and the various kinds of modifications can be implemented without departing from the scope of the technical idea described in the claims, the specification and the drawings. Any shapes, structures and materials which are not directly described in the specification and the drawings can be within the scope of the technical idea of the present invention as long as the functions and effects of the invention are obtained. For example, although the packings formed of an elastic body and arranged in a ring shape are used as the drip-proof members in the embodiment, drip-proof members formed of another material and having another shape and structure may be used. In addition, the shape formed by the drip-proof members does not necessarily need to completely surround the exposure opening of the cover (or the opening of the case) and may surround partially. In detail, for example, to prevent ingress of liquid on the circuit board side, the packings may be arranged in contact with only the bearing-side packing mounting surface and the non-bearing-side packing mounting surface of the cover without contacting with the right- and left-side packing mounting surfaces. In this regard, however, the packings in a ring shape are easier to assemble and also eliminate an unnecessary gap, allowing the cover to be attached to the main unit without wobble. In addition, although the drip-proof processing portion is configured by applying grease in the embodiment, various other drip-proof means such as providing packing may be used to form the drip-proof processing portion. In addition, although the rotational angle of the operating knob is limited by the stopper mechanism (an arc motion) in the embodiment, it may be configured to be 360° rotatable (a rotary motion) or to be able to move in an oscillatory motion other than the rotary motion. In addition, the exposure opening of the cover is arranged to face straight up in the embodiment, but may be arranged to face in another direction (e.g., obliquely upward, horizontal, or obliquely downward, etc.).

The contents of the embodiment described above and shown in the drawings can be combined as long as the purpose and configuration, etc., do not contradict. In addition, the contents described above and shown in the drawings, even a part of them, can be respectively independent embodiments, and the embodiment of the invention is not limited to one embodiment as a combination of the above description and the drawings.

REFERENCE SIGNS LIST

1 ROTARY ELECTRONIC COMPONENT (ELECTRONIC COMPONENT)
20 FIRST CASE (CASE)
21 BEARING
70 SECOND CASE (CASE)
100 OPERATING KNOB
101 OPERATING PORTION
111 SHAFT PORTION
130 SLIDING PIECE (DETECTION MEANS)
160 CIRCUIT BOARD
165 SLIDING CONTACT PATTERN (DETECTION MEANS)
250 PACKING (DRIP-PROOF MEMBER)
250*a* BEARING-SIDE PACKING (DRIP-PROOF MEMBER)
250*d* NON-BEARING-SIDE PACKING (DRIP-PROOF MEMBER)
300 COVER
305 EXPOSURE OPENING
K1 AXIS
H1 OPENING
B1 DRIP-PROOF PROCESSING PORTION

The invention claimed is:

1. A drip-proof structure of an electronic component, comprising:

a rotary body that comprises a main body comprising a circular outer circumferential surface as an operating portion and a shaft portion provided on one side surface of the main body;

a first case that comprises a bearing rotatably supporting the shaft portion of the rotary body;

a second case that is provided integral with the first case so as to have an opening therebetween, supports the other side surface of the main body of the rotary body, and houses, together with the first case, the rotary body while exposing a portion of the circular outer circumferential surface of the rotary body through the opening;

a sliding piece that is provided on the rotary body located inside the first and second cases and changes its position to follow rotation of the rotary body;

a circuit board that comprises a sliding contact pattern to be in sliding contact with the sliding piece and outputs an output signal corresponding to the rotational position of the rotary body;

a cover that comprises an exposure opening for exposing the portion of the circular outer circumferential surface of the rotary body exposed through the opening and covers the first and second cases and the circuit board;

first and second drip-proof members arranged between the first case and the cover and between the second case and the cover, respectively; and a drip-proof processing portion provided between the shaft portion of the rotary body and the bearing, wherein the drip-proof processing portion comprises an end portion of a cylindrical protruding portion serving as the bearing and receiving the shaft portion of the rotary body inserted therein, and a drip-proof recess formed on the shaft portion of the rotary body so as to be concentrically with the shaft portion and receiving the end portion of the protruding portion inserted therein.

2. The drip-proof structure of an electronic component according to claim 1, rotary body;

wherein the first and second drip-proof members comprise a coupling portion extending in an axial direction of the rotary body, wherein an outer circumferential shape of the bearing of the first case is arc-shaped, and wherein the first drip-proof member comprises a curved portion that is located on the bearing side and is formed in an arc shape engaging with the outer shape of the bearing of the first case.

3. The drip-proof structure of an electronic component according to claim 1, wherein the first and second drip-proof members and the coupling portions are ring-shaped, wherein an outer circumferential shape of the bearing of the first case is arc-shaped, and wherein the first drip-proof member comprises a curved portion that is located on the bearing side and is formed in an arc shape engaging with the outer shape of the bearing of the first case.

4. The drip-proof structure of an electronic component according to claim 1, wherein the first and second drip-proof members extend in a direction orthogonal to an axial direction of the rotary body, wherein an outer circumferential shape of the bearing of the first case is arc-shaped, and wherein the first drip-proof member comprises a curved portion that is located on the bearing side and is formed in an arc shape engaging with the outer shape of the bearing of the first case.

* * * * *